US012253074B2

(12) United States Patent
Lin et al.

(10) Patent No.: US 12,253,074 B2
(45) Date of Patent: Mar. 18, 2025

(54) ELECTROMAGNETIC AIR PUMP

(71) Applicant: Wellell Inc., New Taipei (TW)

(72) Inventors: Kao-Hung Lin, New Taipei (TW); Kuan-Chih Chen, New Taipei (TW)

(73) Assignee: WELLELL INC., New Taipei (TW)

( * ) Notice: Subject to any disclaimer, the term of this patent is extended or adjusted under 35 U.S.C. 154(b) by 45 days.

(21) Appl. No.: 18/205,576

(22) Filed: Jun. 5, 2023

(65) Prior Publication Data

US 2023/0400020 A1 Dec. 14, 2023

(30) Foreign Application Priority Data

Jun. 14, 2022 (TW) ..... 111122101

(51) Int. Cl.
*F04B 45/027* (2006.01)

(52) U.S. Cl.
CPC ..... *F04B 45/027* (2013.01)

(58) Field of Classification Search
CPC ..... F04B 45/027; F04B 45/00; F04B 45/047; F04B 43/0054; F04B 43/0063
See application file for complete search history.

(56) References Cited

U.S. PATENT DOCUMENTS 3,597,118 A * 8/1971 Kolfertz ..... A01K 63/042 417/360
3,825,374 A * 7/1974 Kondo ..... F04B 45/04 417/413.1
3,838,944 A * 10/1974 Kolfertz ..... F04B 45/043 417/540
4,154,559 A * 5/1979 Enomoto ..... F04B 45/047 417/413.1
4,180,377 A * 12/1979 Itakura ..... F04B 45/027 417/413.1
4,792,293 A * 12/1988 Wang ..... F04B 45/047 417/571
5,052,904 A * 10/1991 Itakura ..... A01K 63/047 417/413.1
5,137,432 A * 8/1992 Tsai ..... F04B 39/0033 181/240
5,360,323 A * 11/1994 Hsieh ..... F04B 45/047 417/413.1
5,730,587 A * 3/1998 Snyder ..... F04B 17/04 417/413.1
5,765,997 A * 6/1998 You ..... F04B 45/027 417/413.1

(Continued)

*Primary Examiner* — Thomas Fink
(74) *Attorney, Agent, or Firm* — WPAT, PC

(57) ABSTRACT

The present invention discloses an electromagnetic air pump including an air chamber operable to be compressed or expanded. The air chamber is defined by a platform surface and a rubber cap operable to be pressed downward. The rubber cap includes a support and a cover. During the operation of the electromagnetic air pump, the cover is configured to bear against the support with the platform surface when the cover is pressed downward. When the air chamber is compressed or expanded, each pair of geometrically symmetrical parts of the cover corresponds to a pair of displacement changes relative to the platform surface, wherein a difference between the pair of displacement changes is not greater than 5%. Thus, the rubber cap is provided with an effect of a substantially uniform stress.

9 Claims, 7 Drawing Sheets

(56) References Cited

U.S. PATENT DOCUMENTS

| | | | | |
|---|---|---|---|---|
| 6,364,637 | B1 * | 4/2002 | Hase | F04B 45/047 417/413.1 |
| 8,480,382 | B2 * | 7/2013 | Wang | F04B 17/042 318/132 |
| 10,161,392 | B2 * | 12/2018 | Lin | F04B 39/12 |
| 2009/0010778 | A1 * | 1/2009 | Wang | F04B 43/026 417/413.1 |
| 2010/0286597 | A1 * | 11/2010 | Wang | F04B 43/04 604/35 |

* cited by examiner

ELECTROMAGNETIC AIR PUMP

BACKGROUND OF THE INVENTION

Field of the Invention

The present invention relates to an air pump, and more particularly to an electromagnetic air pump in which an air chamber is compressed or expanded by means of electromagnetic control so as to generate an air source.

Description of the Prior Art

Air pumps may be used to generate air sources to supply air to objects that need to be inflated, for example, various inflation objects such as air beds. An electromagnetic air pump, by a control means of compressing or expanding of an air chamber defined internally, inputs air into an object that needs to be inflated when the air chamber is compressed, and draws external air into the air chamber when the air chamber is expanded so as to supply the air into the object that needs to be inflated in the next compression.

During the operation of an electromagnetic air pump, compression and expansion need to be repeatedly performed, and a rubber cap used to define an internal space of the air chamber correspondingly also needs to be frequently squeezed. Thus, the compression effect of the air chamber is generated by collapse deformation of the rubber cap, further outputting the air from the inside of the air chamber. However, such frequent deformation and asymmetric distribution of a received force of a conventional rubber cap easily cause aging of the structure where the deformation occurs and even result in damage, leading to malfunction of air supply of the electromagnetic air pump as well as incurring issues of a shortened lifespan of the electromagnetic air pump.

SUMMARY OF THE INVENTION

It is an object of the present invention to provide a rubber cap in an electromagnetic air pump with a prolonged lifespan of use.

It is another object of the present invention to provide a rubber cap in an electromagnetic air pump with a uniform stress when the rubber cap receives a force.

To achieve the above and other objects, the present invention provides an electromagnetic air pump, including: an air chamber operable to be compressed or expanded, defined by a platform surface and a rubber cap operable to be compressed downward. The rubber cap includes a support and a cover. During the operation of the electromagnetic air pump, the cover is configured to bear against the support with the platform surface. When the air chamber is compressed or expanded, each pair of geometrically symmetrical parts of the cover corresponds to a pair of displacement changes relative to the platform surface, wherein a difference between the pair of displacement changes is not more than 5%, so as to achieve an effect of a substantially uniform stress upon the cover.

To achieve the above and other objects, the present invention further provides an electromagnetic air pump including a cylinder base, a rubber cap and a swing arm. The cylinder base has a platform. The rubber cap defines an air chamber between a bottom portion thereof and the platform. A first end of the swing arm is rotatably disposed on the cylinder base, and a second end is provided with a magnetic element for the swing arm to be controlled by a coil and corresponding press downward or lift the rubber cap. When the rubber cap is pressed downward and the swing arm reaches substantially maximum downward displacement, a compression stroke on a first side of the rubber cap near the first end is substantially equal to a compression stroke on a second side near the second end, so as to achieve an effect of a substantially uniform stress on the first and second sides of the rubber cap.

To achieve the above and other objects, the present invention further provides an electromagnetic air pump including a cylinder base, a rubber cap set, a swing arm set and a coil set. The cylinder base has two platforms configured on two opposite sides. The rubber cap set includes two rubber caps respectively disposed on the two corresponding platforms on the two opposite sides of the cylinder base, and each of the rubber caps defines an air chamber between a bottom portion thereof and the correspondingly abutted platform. The swing arm set includes two swing arms. A first end of each of the swing arms is rotatably disposed on the cylinder base, and a second end of each of the swing arms is provided with a magnetic element. The swing arms are connected to the corresponding rubber caps. The coil set faces the magnetic elements and is configured to generate a magnetic force when energized so as to rotate the swing arms and to correspondingly compress or lift the rubber caps. Platform surfaces of the two platforms of the cylinder base are non-parallel to each other, such that an effect of a substantially uniform stress is achieved when the rubber caps are compressed by rotations of the swing arms.

In one embodiment of the present invention, in a state in which the swing arm presses the rubber cap downward to complete a compression procedure, an included angle between the platform and the swing arm may be less than 5 degrees.

In one embodiment of the present invention, the height of the platform of the cylinder base near the first end of the swing arm may be configured to be more than the height of the platform near the second end of the swing arm, and the platform appears as an inclined surface.

In one embodiment of the present invention, the height of the rubber cap near the first end of the swing arm may be configured to be more than the height of the rubber cap near the second end of the swing arm, and the rubber cap appears inclined.

In one embodiment of the present invention, the swing arm includes a link assembly. The link assembly has a slide block and a rotating column rotatably disposed on the slide block. The slide block is movably disposed on the swing arm so as to drive the rotating column to move on the swing arm. One end of the rotating column is fixed on a top portion of the rubber cap.

In one embodiment of the present invention, the swing arm has a limiting groove. The rotating column moves in the limiting groove such that the slide block is provided with a restricted degree of motion. A boundary value of the degree of motion is for the rubber cap to be pressed downward in a uniform manner, and another boundary value of the degree of motion is for the rubber cap to not receive a downward pressure.

Accordingly, by controlling the squeezing conditions of squeezing the rubber cap, a force received when the rubber cap is squeezed substantially exhibits substantial uniformity, eliminating the issue of overly partially squeezing the part where the rubber cap is located, hence prolonging the lifespan of use of the rubber cap in the electromagnetic air pump.

DETAILED DESCRIPTION OF THE EMBODIMENTS

Objectives, features, and advantages of the present disclosure are hereunder illustrated with specific embodiments, depicted with drawings, and described below.

In the disclosure, descriptive terms such as "include, comprise, have" or other similar terms are not for merely limiting the essential elements listed in the disclosure, but can include other elements that are not explicitly listed and are however usually inherent in the components, structures, devices, portions, sections or regions.

In the disclosure, the terms similar to ordinals such as "first" or "second" described are for distinguishing or referring to associated identical or similar components or structures, and do not necessarily imply the orders of these components, structures, devices, portions, sections or regions in a spatial aspect. It should be understood that, in some situations or configurations, the ordinal terms could be interchangeably used without affecting the implementation of the present invention.

In the disclosure, descriptive terms such as "a" or "one" are used to describe the components, structures, devices, portions, sections or regions, and are for illustration purposes and providing generic meaning to the scope of the present invention. Therefore, unless otherwise explicitly specified, such description should be understood as including one or at least one, and a singular number also includes a plural number.

Figure 1:
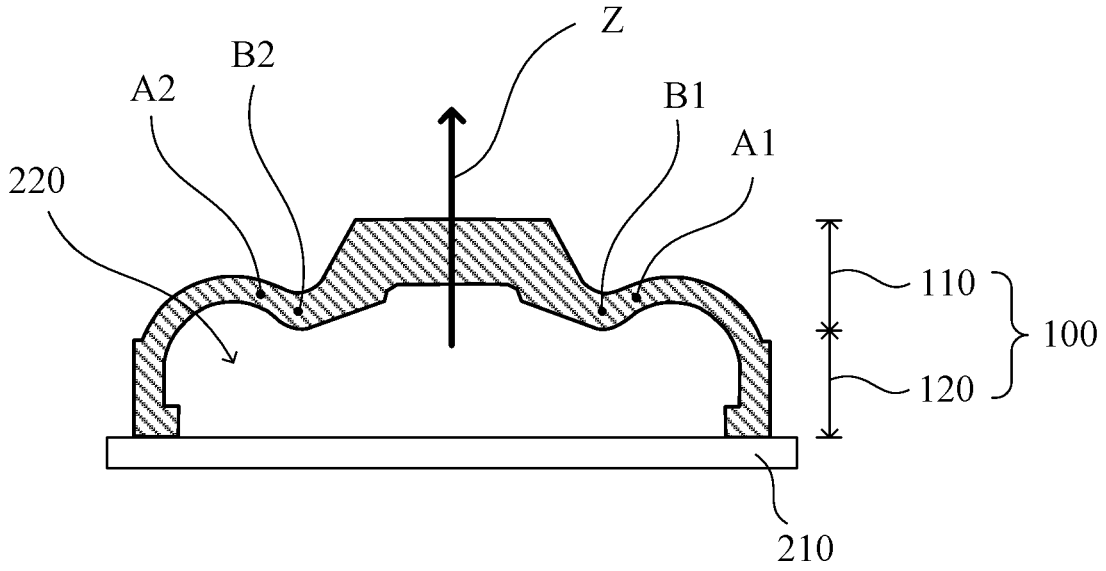
FIG. 1 is a section schematic diagram of a rubber cap that is not compressed in an electromagnetic pump according to an embodiment of the present invention.
Figure 2:
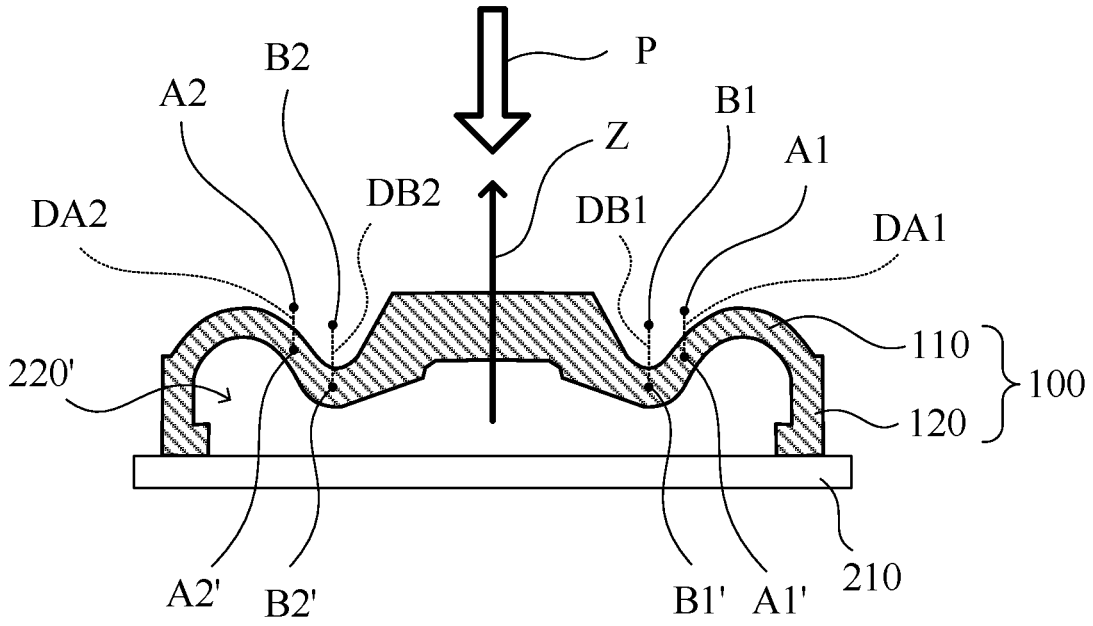
FIG. 2 is a section schematic diagram of the rubber cap of the embodiment in FIG. 1 that is compressed.
Figure 3:
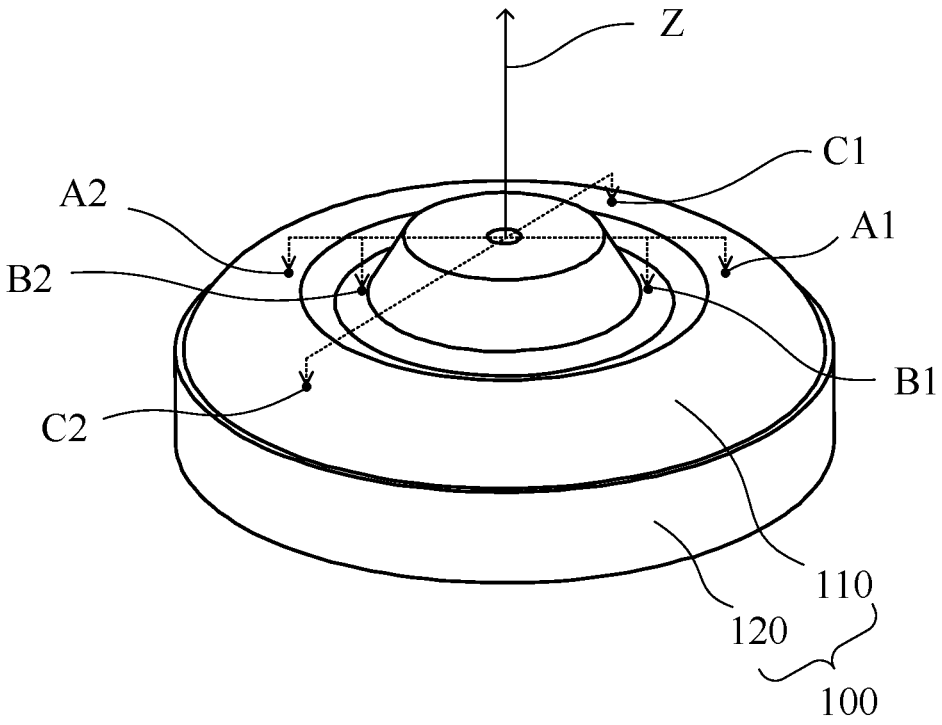
FIG. 3 is a perspective schematic diagram of the rubber cap of the embodiment in FIG. 1.

Refer to FIG. 1, FIG. 2 and FIG. 3. FIG. 1 shows a section schematic diagram of a rubber cap that is not compressed in an electromagnetic pump according to an embodiment of the present invention. FIG. 2 shows a section schematic diagram of the rubber cap of the embodiment in FIG. 1 that is compressed. FIG. 3 shows a perspective schematic diagram of the rubber cap of the embodiment in FIG. 1.

In the electromagnetic air pump, the rubber cap 100 may be formed to have the shape of a cover to coordinate with a platform 210, so as to further define a space of an air chamber 220. The air chamber 220 has an output air channel (not shown) for supplying air to an object to be inflated and an input air channel (not shown) for drawing external air. When the rubber cap 100 that is both elastic and flexible is pressed downward by a pressure P received, the space of the air chamber 220 is compressed (air chamber 220'), and the air pushed out is at the same time discharged via the output air channel and transported to the object to be inflated. On the other hand, after being pressed downward, the rubber cap 100 is lifted to restore the space of the air chamber 220, while the external air is drawn into the air chamber 220 via the input air channel.

The rubber cap 100 may include a cover 110 and a support 120. The support 120 is used as a part for the rubber cap 100 to abut against the platform 210. The cover 110 connected above the support 120 usually serves as a part that is pressed downward and a part that provides main deformation, so as to define the air chamber 220' (referring to FIG. 2) that is compressed or the air chamber 220 (referring to FIG. 1) that is not compressed in between with the platform 210. A lower edge of the support 120 may be directly born by the platform 210 (as shown in FIG. 1 and FIG. 2), or may serve as a fastening portion that enables the rubber cap 100 to be stably abutted against the platform 210 to further enhance airtightness. Associated details are to be described below. In some embodiments, the support 120 may also coordinate with the cover 110 that is pressed downward to generate slight deformation, and this does not substantially affect the overall airtightness.

The rubber cap 100 needs to withstand a degree of deformation brought during the operation process when it is pressed downward and lifted. More particularly, the cover 110 of the rubber cap 100 needs to withstand a larger degree of deformation. While the cover 110 is compressed and in a compressed state, one part on the cover 110 has a displacement change at a position with regard to the platform 210. To prolong the lifespan of use of the rubber cap 100, in this embodiment, the cover 110 has a pair of geometrically symmetric parts, and the two respective displacement changes have a difference that is limited to be not more than 5%. On the basis of the configuration of the electromagnetic air pump and in terms of control of pressing downward and lifting the rubber cap 100, the above configuration provides boundary conditions to be followed, and at the same time helps achieve an effect of a substantial uniform stress. It should be noted that, at least a pair of geometrically symmetric parts on the cover 110 at the same time may also be parts that withstand the largest deformation pressure, and these parts on the cover usually may have a larger thickness or be formed by a material with higher flexibility resistance when given the same thickness.

The so-called geometrically symmetric parts on the cover 110 refer to two parts on the cover 110 that exhibit symmetry with respect to a middle part. For example, for the rubber cap 100 that typically appears as a disc in shape in FIG. 3, two points A1 and A2 exhibit geometric symmetric with respect to a center axis Z at the middle part, two points B1 and B2 exhibit geometric symmetry with respect to the center axis Z at the middle part, and two points C1 and C2 exhibit geometric symmetry with respect to the center axis Z at the middle part. In an implementation form in which the rubber cap 100 is not typically a disc in shape, geometrically symmetric parts may also be defined, and it should be noted that FIG. 3 shows some examples that are not to be construed as limitations.

The displacement changes of the two points A1 and A2 and the two points B1 and B2 are further described with reference to FIG. 1 and FIG. 2 below. When the cover 110 changes from a non-compressed state to a compressed state, the point A1 of the cover 110 changes to the position of a point A1' and has a displacement change DA1. Similarly, the point A2 of the cover 110 changes to the position of a point A2', and has a displacement change DA2. On the basis that the point A1 and the point A2 are a pair of geometrically symmetric parts, the displacement change DA1 and the displacement change DA2 are accordingly a pair of displacement changes. Under the above boundary conditions, the difference (or referred to as a discrepancy) between the displacement change DA1 and the displacement change DA2 may not be more than 5%.

Similarly, when the cover 110 changes from a non-compressed state to a compressed state, the point B1 of the cover 110 changes to the position of a point B1' and has a displacement change DB1. Similarly, the point B2 of the cover 110 changes to the position of a point B2', and has a displacement change DB2. On the basis that the point B1 and the point B2 are a pair of geometrically symmetric parts, the displacement change DB1 and the displacement change DB2 are accordingly a pair of displacement changes, between which a difference also needs to be less than 5%, so as to enable the rubber cap 100 to achieve an effect of a substantially uniform stress.

Figure 4:
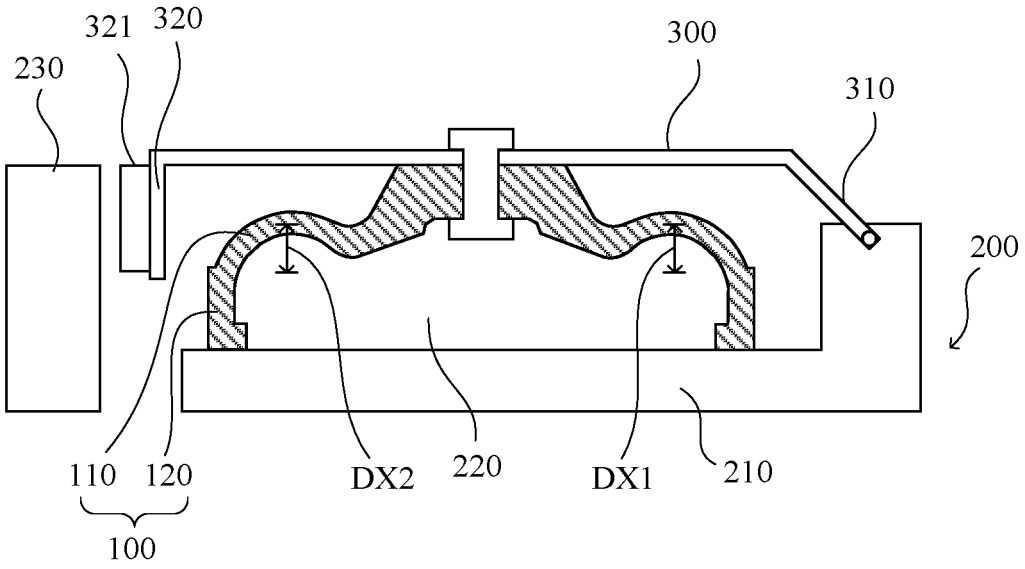
FIG. 4 is a section schematic diagram of an electromagnetic pump according to an embodiment of the present invention.

Refer to FIG. 4 showing a section schematic diagram of an electromagnetic pump according to an embodiment of the present invention. The electromagnetic air pump includes a rubber cap 100, a cylinder base 200 and a swing arm 300. A first end 310 of the swing arm 300 is rotatably disposed on the cylinder base 200, and a second end 320 of the swing arm 300 is provided with a magnetic element 321. A platform 210 of the cylinder base 200 and the rubber cap 100 define a space of an air chamber 220. A coil in a coil device 230 is energized to generate an electromagnetic field, and a magnetic field change accompanied by a change in the power frequency between the coil and the magnetic element 321 produces a mutually attractive or mutually repulsive force of action. This force of action pushes the swing arm 300 to perform a repetitive rotational motion to a certain extent on the basis of the first end 310, further generating a control action of pressing downward the rubber cap 100 or lifting the rubber cap 100, so as to achieve the control means of compressing or expanding the air chamber.

On the basis of the uniform stress achieved for the rubber cap 100, when the rubber cap 100 is pressed downward and the swing arm 300 reaches substantially maximum downward displacement, or when the downward pressure exerted on the rubber cap 100 by the swing arm 300 reaches a substantially maximum amount of downward pressure, a compression stroke DX1 on a first side of the first end 310 near of the rubber cap 100 is controlled to be substantially equal to a compression stroke DX2 on a second side of the second end 320 near the rubber cap 100. From another perspective, under the above configuration, a difference between the compression stroke DX1 and the compression stroke DX2 is inhibited.

Figure 5:
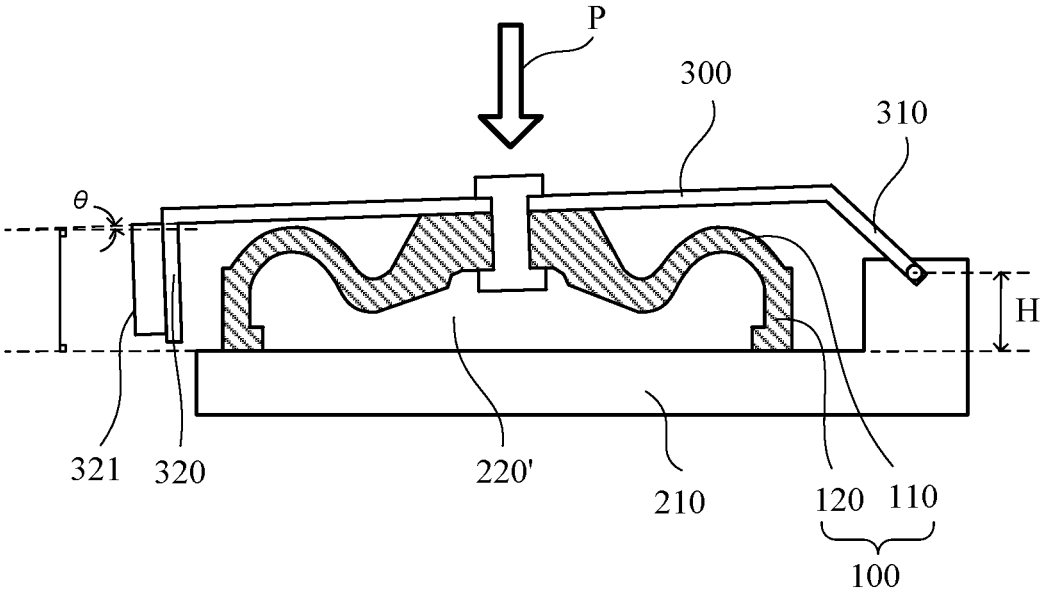
FIG. 5 is a section schematic diagram of an electromagnetic pump when a swing arm is pressed downward in a first implementation form according to an embodiment of the present invention.

Refer to FIG. 5 showing a section schematic diagram of an electromagnetic air pump when a swing arm is pressed downward in a first implementation form according to an embodiment of the present invention. A main section connecting the swing arm 300 and the rubber cap 100 exhibits a shape of a straight long swing arm, and a matching condition between this section and the platform 210 can be used to define boundary conditions for achieving a uniform stress upon the rubber cap. The swing arm 300 is configured to press the cover 110 of the rubber cap 100 downward via the connecting part to generate an air chamber 220'. When the electromagnetic air pump operates such that the swing arm 300 reaches a substantially maximum downward displacement, an included angle θ between the platform 210 and the swing arm 300 needs to be less than 5 degrees. A surface with respect to the rubber cap 100 may be defined on the platform 210, and an extension of this surface and an extension of the swing arm 300 in a shape of a long swing arm may define this included angle θ. With the defined condition of the included angle θ, an effect of a substantially uniform stress upon the rubber cap is achieved.

In the implementation form in FIG. 5, usually a connecting position between the cylinder base 200 and the first end 310 of the swing arm 300 is reduced (that is, reducing the height H) or the appearance of the first end 310 of the swing arm 300 is changed, so that the swing arm 300 is enabled to form an approximately parallel state (that is, an included angle θ of less than 5 degrees) when the it is reaches the substantially maximum downward displacement. The description above is primarily associated with the implementation form of the swing arm 300. In the description below, details of the implementation form in FIG. 6 primarily associated with the implementation form of the platform 210 are given.

Figure 6:
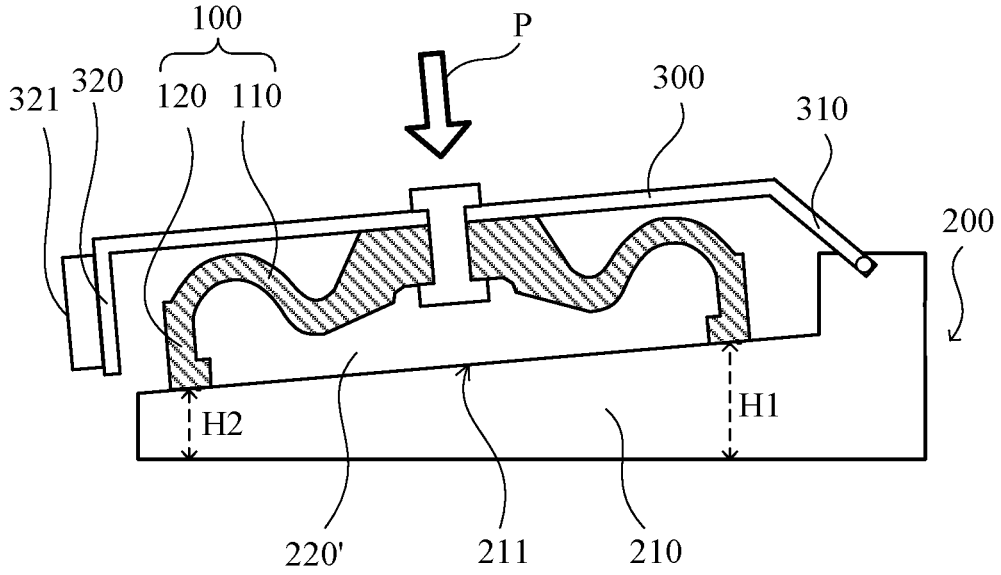
FIG. 6 is a section schematic diagram of an electromagnetic pump when a swing arm is pressed downward in a second implementation form according to an embodiment of the present invention.

Refer to FIG. 6 showing a section schematic diagram of an electromagnetic air pump when a swing arm is pressed downward in a second implementation form according to an embodiment of the present invention. Compared to the implementation form in the example in FIG. 5, in the implementation form in FIG. 6, the height of the platform 210 of the cylinder base 200 is changed, so that the swing arm 300 is enabled to form an approximately parallel state relative to the platform 210 when it reaches the substantially maximum downward displacement. As shown in FIG. 6, a height H1 of a platform surface 211 of the platform 210 of the cylinder base 200 near the first end 310 is more than the height H2 of the platform surface 211 near the second end 320. From perspectives of the section diagram shown in FIG. 6, the platform surface 211 exhibits a state of an inclined surface.

In the implementation form in FIG. 6, with the arrangement of the height of the platform surface 211 of the platform 210 of the cylinder base 200, non-uniform pressure generated upon the cover 110 of the rubber cap 100 when the swing arm 300 reaches the substantially maximum downward displacement is eliminated. In other combination implementation form, both the exemplary implementation forms shown in FIG. 5 and FIG. 6 may be adopted, so that height requirements on the platform 210 of the cylinder base 200 may be less strict and adjustment requirements on the swing arm 300 may also be less strict, hence achieving a balance. Any one of the exemplary implementations forms in FIG. 5, FIG. 6 and a combination implementation form of FIG. 5 and FIG. 6 is capable of achieving an effect of a substantially uniform stress on the rubber cap 100.

Figure 7:
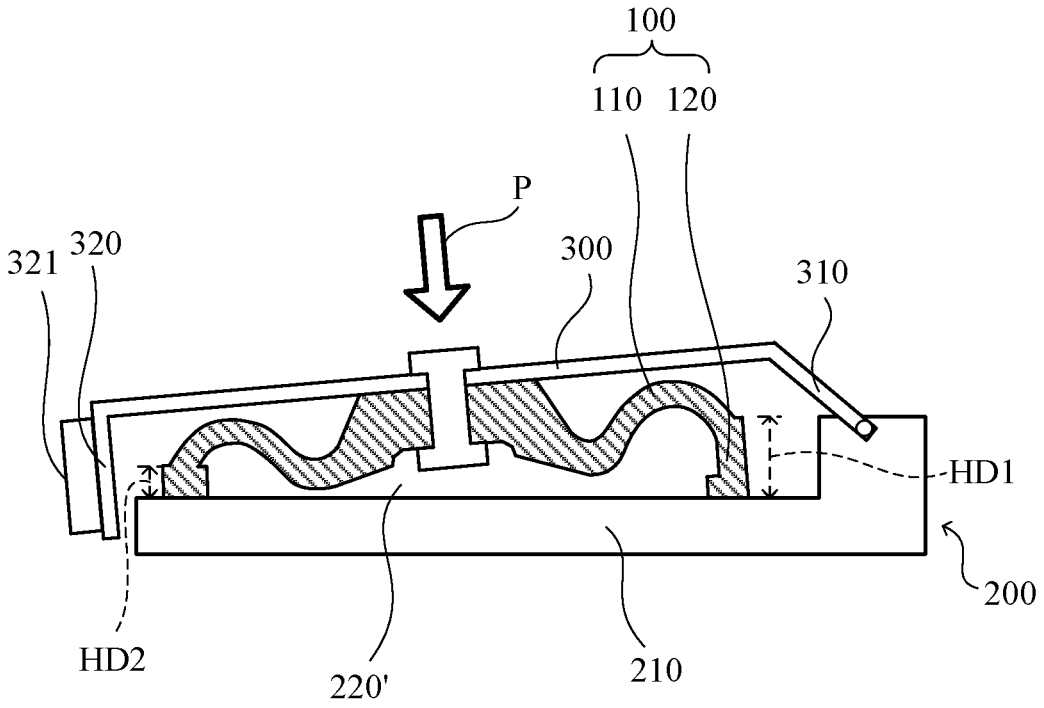
FIG. 7 is a section schematic diagram of an electromagnetic pump when a swing arm is pressed downward in a third implementation form according to an embodiment of the present invention.

Refer to FIG. 7 showing a section schematic diagram of an electromagnetic pump when a swing arm is pressed downward in a third implementation form according to an embodiment of the present invention. Compared to the exemplary implementation form in FIG. 6, in the implementation form in FIG. 7, the change in the height of the platform 210 of the cylinder base 200 is accomplished by a height difference of the support 120 of the rubber cap 100, so that a substantially uniform stress upon the rubber cap 100 is achieved when the swing arm 300 reaches the substantially maximum downward displacement. As shown in FIG. 7, a height HD1 of the support 120 of the rubber cap 100 near the first end 310 is more than a height HD2 near the second end 320. From perspectives of the section diagram shown in FIG. 7, the rubber cap 100 exhibits an inclined state. In other words, the height of the rubber cap 100 near the first end 310 of the swing arm 300 is more than the height near the second end 320 of the swing arm 300.

Figure 8:
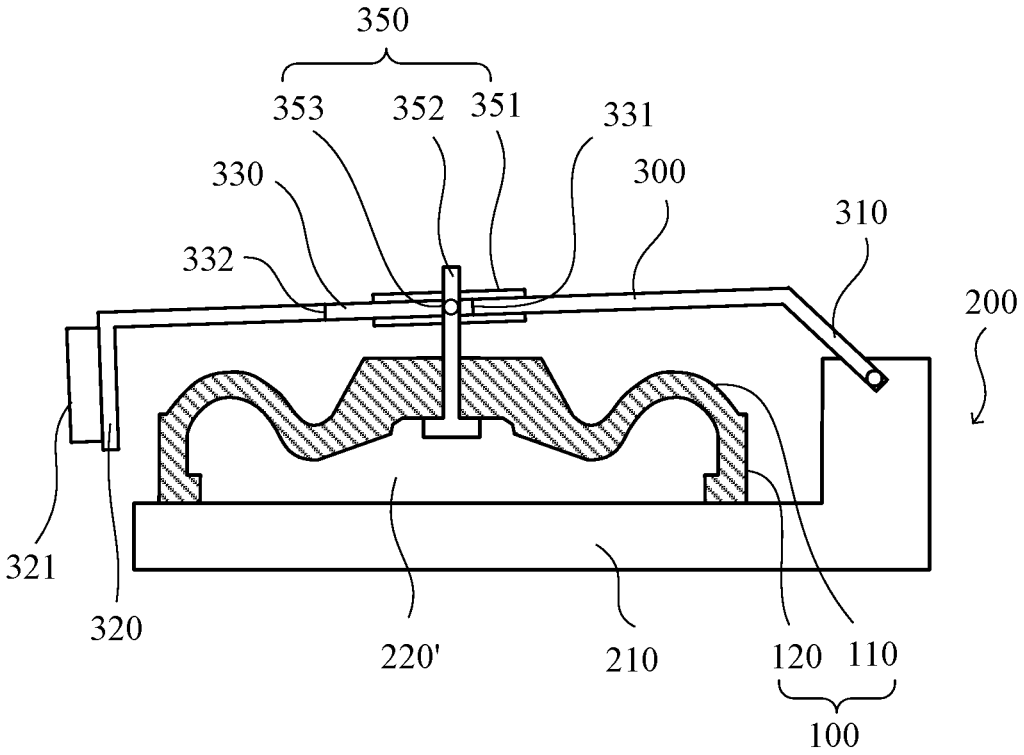
FIG. 8 is a section schematic diagram of an electromagnetic pump when a swing arm is pressed downward in a fourth implementation form according to an embodiment of the present invention.
Figure 9:
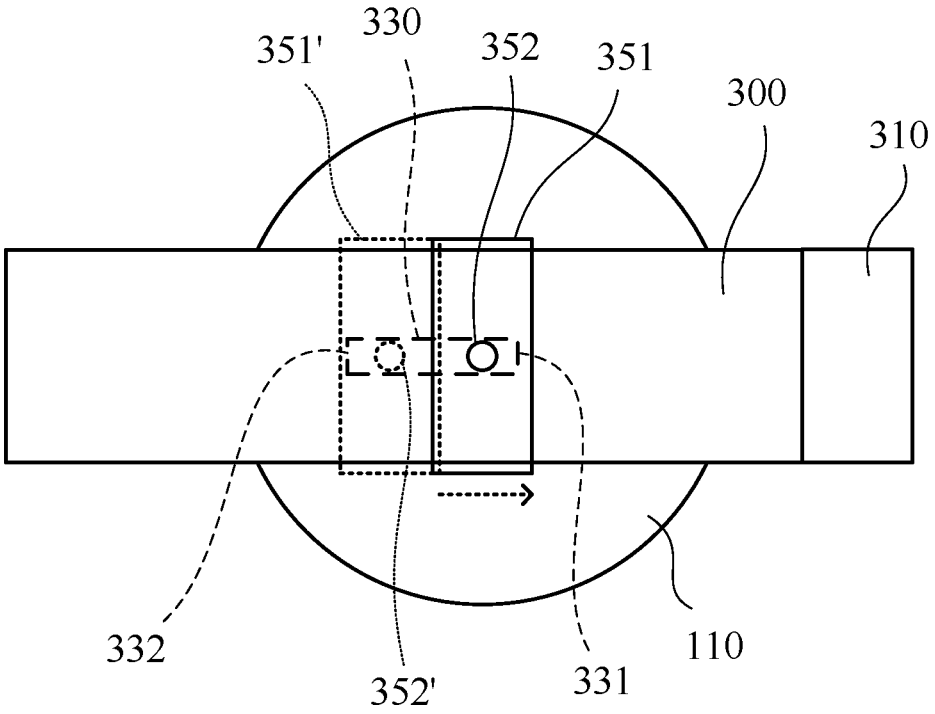
FIG. 9 is a top schematic diagram of the swing arm and the rubber cap of the implementation form in FIG. 8.

Refer to FIG. 8 and FIG. 9. FIG. 8 shows a section schematic diagram of an electromagnetic pump when a swing arm is pressed downward in a fourth implementation form according to an embodiment of the present invention. FIG. 9 shows a top schematic diagram of the swing arm and the rubber cap of the implementation form in FIG. 8. In the implementation form in FIG. 8, the swing arm 300 further includes a link assembly 350. The link assembly 350 includes a slide block 351 and a rotating column 352. With a rotating shaft 353 and a limiting groove 330 of the swing arm 300, the rotating column 352 slides in the limiting groove 330 along with a rotation of the swing arm 300. The rotating column 352 slides in the limiting groove 330 in an adaptive manner. That is, when the swing arm 300 performs a downward pressing stroke, the rotating column 352 slides to the right in the limiting groove 330; conversely, when the swing arm 300 performs a lift stroke, the rotating column 352 slides to the left in the limiting groove 330. Accordingly, the rotating column 352 is rotatably disposed on the slide block 351 via the rotating shaft 353, and the slide block 351 is movably disposed on the swing arm 300 via the limiting groove 330. The slide block 351 drives the rotating column 352 to move on the swing arm 300 while moving, and one end of the rotating column 352 is fixed on a top portion of the cover 110.

As shown in FIG. 9, with downward pressing of the swing arm 300, the rotating column 352 drives the slide block 351 to slide from an original position (an original slide block position 351', an original rotating column position 352') to the right (toward the first end 310 of the swing arm 300). The length of limiting groove 330 may be defined as restricted degrees of motion of the slide block 351 and the rotating column 352.

In one implementation, a first boundary 331 of the limiting groove 330 is a boundary value that achieves a uniform pressure upon the cover 110. That is, on the basis of the rotatability of the rotating shaft 353 and an increasing included angle generated with respect to the top portion of the cover 110 as the swing arm 300 presses downward, the rotating shaft 353 forms a characteristic of adaptively sliding toward the first end 310 of the swing arm 300. Accordingly, with respect to the restricted degrees of motion provided to the rotating shaft 353 by the limiting groove 330, the first boundary 331 may be configured as a boundary value that achieves a uniform downward pressure upon the cover 110 while the swing arm 300 reaches the substantially maximum downward displacement. On the other hand, a second boundary 332 may be configured as a boundary value for the rubber cap 100 to not receive a downward pressure once the swing arm 300 is lifted.

The implementation forms above may be collaboratively coordinated. Apart from the coordination of the exemplary implementation forms in FIG. 5 and FIG. 6, the exemplary implementation form in FIG. 7 may also be coordinated with the exemplary implementation form in FIG. 5 or FIG. 6, or be coordinated with both of the exemplary implementation forms in FIG. 5 and FIG. 6. Moreover, the implementation form in FIG. 8 may also be selectively coordinated with the exemplary implementation forms in FIG. 5, FIG. 6 and FIG. 7. The application of these combinations is capable of achieving an effect of a substantially uniform stress upon the rubber cap.

Figure 10:
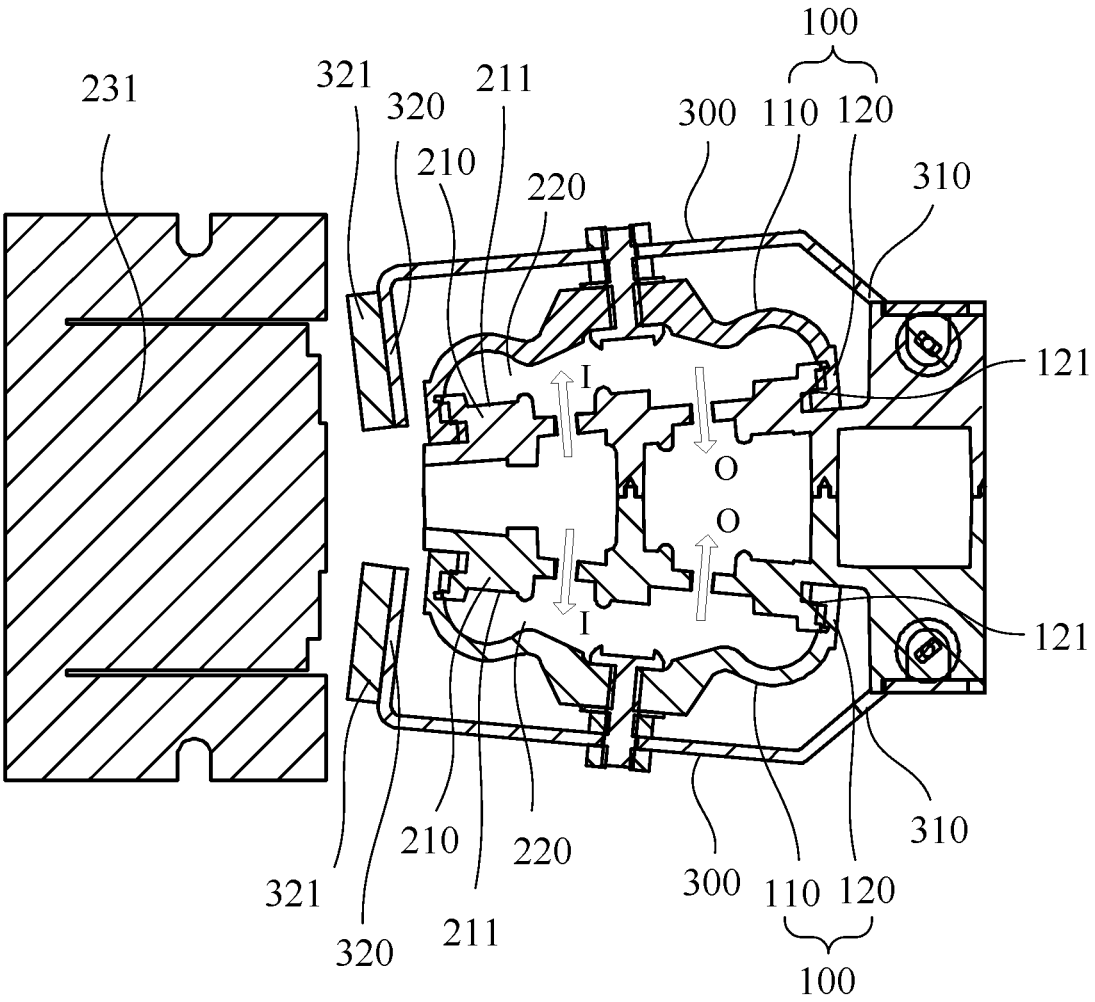
FIG. 10 is a section schematic diagram of an electromagnetic pump when a swing arm is not pressed downward in a fifth implementation form according to an embodiment of the present invention.
Figure 11:
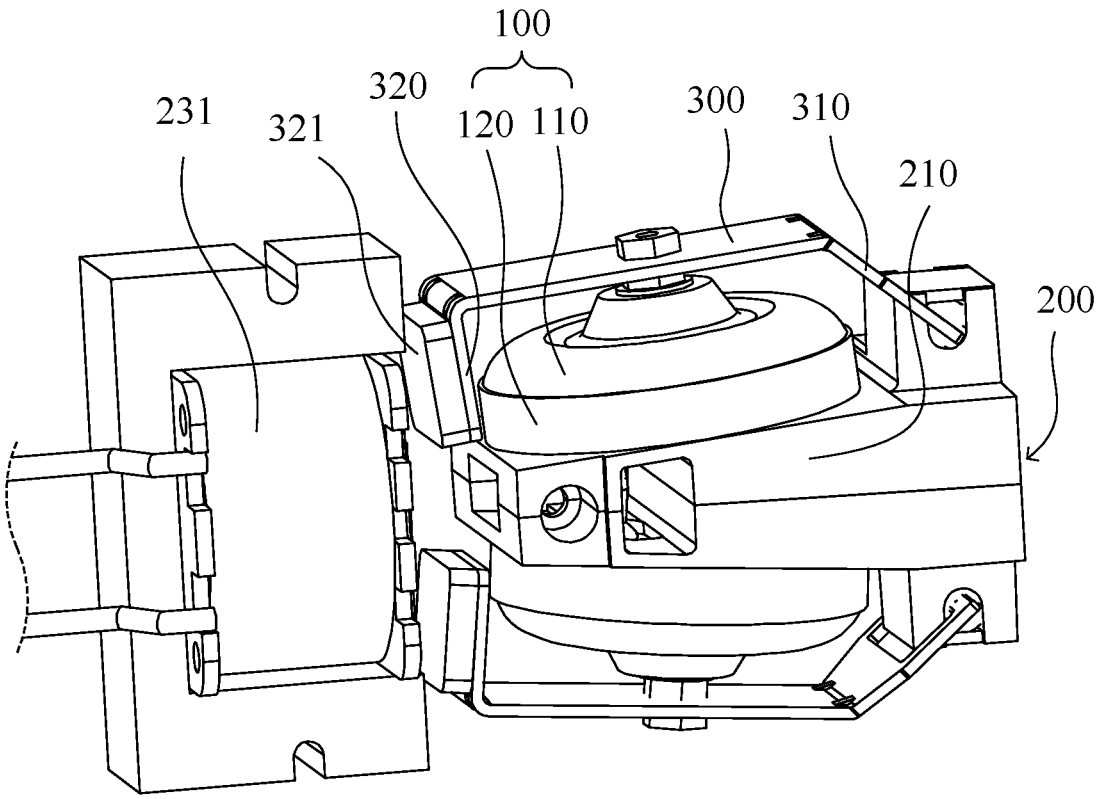
FIG. 11 is a perspective schematic diagram of part of the electromagnetic pump of the implementation form in FIG. 10.

Refer to FIG. 10 and FIG. 11. FIG. 10 shows a sectional schematic diagram of an electromagnetic air pump when a swing arm is not pressed downward in a fifth implementation form according to an embodiment of the present invention. FIG. 11 shows a perspective schematic diagram of part of the electromagnetic air pump of the implementation form in FIG. 10. To present the drawings clearly and concisely, only the numerals of the elements on one side are indicated.

The exemplary implementation forms in FIG. 10 and FIG. 11 are based on the implementation form in FIG. 6 and are also examples that enhance the efficiency of an electromagnetic air pump by using multiple rubber cap sets. As shown in FIG. 10 and FIG. 11, an electromagnetic air pump includes a cylinder base 200, a rubber cap set, a swing arm set and a coil set 231. The cylinder base 200 has two platforms 210 configured on two opposite sides. Rubber caps 100 include two rubber caps 100 respectively disposed on the two corresponding platforms on the two opposite sides of the cylinder base 200. Each of the rubber caps 100 defines an air chamber between a bottom portion thereof and the correspondingly abutted platform 210. In the exemplary implementation forms in FIG. 10 and FIG. 11, a support 120 of the rubber cap 100 has a fastening portion 121 to stably abut on the platform 210, and to define a space of an air chamber 220 in between with an upper surface of the platform 210. The air chamber 200 has an output air channel O to supply air to an object to be inflated and an input air channel I to draw external air.

The swing arm set includes two swing arms 300. A first end of each of the swing arms 300 is rotatably disposed on the cylinder base 200. A second end 320 of each of the swing arms 300 is provided with a magnetic element 321. Each of the swing arms 300 is connected to the corresponding rubber cap 100 so as to face the coil set 231 of the magnetic element 321. The coil set 231 is energized to generate a magnetic force to rotate each of the swing arms 300 so as to correspondingly compress or lift the corresponding rubber cap, further compressing (discharging air pushed out via the output air channel O) or expanding (drawing external air via the input air channel I) the air chamber 220.

In the exemplary implementation form in FIG. 10, platform surfaces 211 of two platforms 210 of the cylinder base 200 are non-parallel to each other (as observed from FIG. 11), and correspondingly, as the basic exemplary implementation form shown in FIG. 6, an effect of a substantially uniform stress upon the rubber cap 100 is achieved when the rubber cap 100 is compressed by a rotation of the swing arm 300.

In conclusion, by regulating the control means on the rubber cap, an effect of a substantially uniform stress upon the rubber cap is achieved by compressing and lifting the rubber cap during the operation of an electromagnetic air pump. This prolongs the lifespan of the rubber cap and reduces its malfunction rate, thus improving the reliability of the electromagnetic air pump.

The present disclosure is illustrated by various aspects and embodiments. However, persons skilled in the art understand that the various aspects and embodiments are illustrative rather than restrictive of the scope of the present disclosure. After perusing this specification, persons skilled in the art may come up with other aspects and embodiments without departing from the scope of the present disclosure. All equivalent variations and replacements of the aspects and the embodiments must fall within the scope of the present disclosure. Therefore, the scope of the protection of rights of the present disclosure shall be defined by the appended claims.

What is claimed is:

1. An electromagnetic air pump, comprising:

a swing arm driven by a force generated by an electromagnetic field;

a cylinder base having a platform surface, wherein a first end of the swing arm is rotatably disposed on the cylinder base, a second end of the swing arm opposite to the first end is provided with a magnetic element for the swing arm, when controlled by a coil, to correspondingly press downward or lift the cover, a height of the platform surface of the cylinder base near the first end is greater than a height of the platform surface of the cylinder base near the second end, and the platform surface appears as an inclined surface; and an air chamber operable to be compressed or expanded, defined by the platform surface and a rubber cap operable to be compressed downward by the swing arm, the rubber cap comprising a support and a cover, the cover configured to bear against the support with the platform surface when compressed by the swing arm during an operation of the electromagnetic air pump;

wherein when the air chamber is compressed or expanded, each pair of geometrically symmetrical parts of the cover corresponds to a pair of displacement changes relative to the platform surface, and a difference between the pair of displacement changes is not greater than 5%, so as to achieve an effect of a uniform stress upon the cover.

2. The electromagnetic air pump according to claim 1, wherein, an included angle between the platform surface and the swing arm is less than 5 degrees in a state in which the swing arm presses the cover downward such that the air chamber is compressed.

3. An electromagnetic air pump, comprising:

a cylinder base having a platform, a height of the platform of the cylinder base near the first end of the swing arm is greater than a height of the platform near the second end of the swing arm, and the platform appears as an inclined surface;

a rubber cap defining an air chamber between a bottom portion thereof and the platform; and a swing arm, a first end of thereof rotatably disposed on the cylinder base, and a second end thereof provided with a magnetic element for the swing arm to be controlled by a coil and corresponding press downward or lift the rubber cap;

wherein when the rubber cap is pressed downward and the swing arm reaches substantially maximum downward displacement, a compression stroke on a first side of the rubber cap near the first end is substantially equal to a compression stroke on a second side near the second end, so as to achieve a substantially uniform stress on the first and second sides of the rubber cap.

4. The electromagnetic air pump according to claim 3, wherein in a state in which the swing arm presses the rubber cap downward to complete a compression procedure, an included angle between the platform and the swing arm is less than 5 degrees.

5. An electromagnetic air pump, comprising:

a cylinder base having two platforms configured on two opposite sides;

a rubber cap set comprising two rubber caps respectively disposed on the two corresponding platforms on the two opposite sides of the cylinder base, and each of the rubber cap defines an air chamber between a bottom portion thereof and the correspondingly abutted platform;

a swing arm set comprising two swing arms, a first end of each of the swing arms rotatably disposed on the cylinder base, and a second end of each of the swing arms provided with a magnetic element, the swing arms connected to the corresponding rubber caps; and a coil set facing the magnetic elements and configured to generate a magnetic force when energized so as to rotate the swing arms and to correspondingly compress or lift the rubber caps;

wherein platform surfaces of the two platforms of the cylinder base are non-parallel to each other, such that an effect of a substantially uniform stress is achieved when the rubber caps are compressed by rotations of the swing arms.

6. The electromagnetic air pump according to claim 5, wherein in a state in which the swing arm presses the rubber cap downward to complete a compression procedure, an included angle between each of the swing arms and the corresponding platform surface is less than 5 degrees.

7. The electromagnetic air pump according to claim 5, wherein a height of the platform near the first end of the corresponding swing arm is greater than a height near the second end of the corresponding swing arm.

8. The electromagnetic air pump according to claim 5, wherein the swing arm comprises a link assembly, the link assembly has a slide block and a rotating column rotatably disposed on the slide block, the slide block is movably disposed on the swing arm so as to drive the rotating column to move on the swing arm, and one end of the rotating column is fixed on a top portion of the rubber cap.

9. The electromagnetic air pump according to claim 8, wherein the swing arm has a limiting groove, the rotating column moves in the limiting groove such that the slide block is provided with a restricted degree of motion, a boundary value of the degree of motion is for the rubber cap to be pressed downward in a uniform manner, and another boundary value of the degree of motion is for the rubber cap to not receive a downward pressure.

* * * * *